US008883709B2

(12) United States Patent
Nechyporenko

(10) Patent No.: US 8,883,709 B2
(45) Date of Patent: Nov. 11, 2014

(54) LAUNDRY PRETREATMENT COMPOSITIONS CONTAINING FATTY ALCOHOLS

(75) Inventor: Vasyl A. Nechyporenko, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 590 days.

(21) Appl. No.: 12/727,894

(22) Filed: Mar. 19, 2010

(65) Prior Publication Data

US 2011/0230383 A1 Sep. 22, 2011

(51) Int. Cl.

| | |
|---|---|
| ***C11D 1/66*** | (2006.01) |
| ***C11D 1/825*** | (2006.01) |
| ***C11D 17/00*** | (2006.01) |
| ***C11D 3/386*** | (2006.01) |
| *C11D 1/72* | (2006.01) |
| *C11D 3/20* | (2006.01) |

(52) U.S. Cl.

CPC ..... *C11D 3/38663* (2013.01); *C11D 1/66* (2013.01); *C11D 1/72* (2013.01); *C11D 3/202* (2013.01); *C11D 3/2031* (2013.01); *C11D 3/2006* (2013.01); *C11D 3/2013* (2013.01)

USPC ..... 510/417; 510/276; 510/392; 510/437

(58) Field of Classification Search

USPC ..... 510/392, 393, 276, 417, 437

See application file for complete search history.

(56) References Cited

U.S. PATENT DOCUMENTS

| | | | | |
|---|---|---|---|---|
| 3,741,902 | A | 6/1973 | Barrett | |
| 4,090,973 | A | 5/1978 | Maguire, Jr. et al. | |
| 4,142,999 | A | 3/1979 | Bloching et al. | |
| 4,272,396 | A | 6/1981 | Fukano et al. | |
| 4,711,739 | A | 12/1987 | Kandathil | |
| 5,281,355 | A * | 1/1994 | Tsaur et al. | 510/393 |
| 5,731,278 | A * | 3/1998 | Nair et al. | 510/320 |
| 5,820,637 | A | 10/1998 | Bory et al. | |
| 6,908,962 | B1 * | 6/2005 | Frankenbach et al. | 524/588 |
| 7,491,362 | B1 | 2/2009 | Geret et al. | |
| 2004/0266653 | A1 * | 12/2004 | Delplancke et al. | 510/470 |
| 2005/0273942 | A1 * | 12/2005 | Ferguson et al. | 8/115.51 |
| 2006/0287211 | A1 * | 12/2006 | Barbizan et al. | 510/367 |
| 2007/0197418 | A1 * | 8/2007 | Rahse | 510/407 |
| 2009/0170744 | A1 * | 7/2009 | Meine et al. | 510/302 |
| 2009/0281010 | A1 * | 11/2009 | Bastigkeit et al. | 510/102 |
| 2010/0022437 | A1 * | 1/2010 | Artiga-Gonzalez et al. | 512/4 |

FOREIGN PATENT DOCUMENTS

WO 2009156317 A1 12/2009

OTHER PUBLICATIONS

PCT/US2011/000491 International Search Report dated Jul. 11, 2011.

* cited by examiner

*Primary Examiner* — Tri V Nguyen

(57) ABSTRACT

A liquid composition for treatment of stained fabric is disclosed. The composition may be an aqueous emulsion that includes a fatty alcohol as a stabilizing agent. The composition may also include one or more nonionic surfactants, detersive enzymes, borax, cleaning agents, fragrances, pH adjusting agents, thickeners, and preservatives. The composition may remain a stable emulsion after even long term storage at various temperatures. Moreover, the composition's improved stability is achieved without significantly sacrifice of its stain removal performance.

19 Claims, No Drawings

LAUNDRY PRETREATMENT COMPOSITIONS CONTAINING FATTY ALCOHOLS

BACKGROUND

1. Technical Field

A liquid composition for treatment of stained fabric is disclosed. The composition may be an aqueous emulsion that includes a fatty alcohol as a stabilizer. The composition may also include one or more nonionic surfactants, detersive enzymes, borax, cleaning agents, fragrances, pH adjusting agents, thickeners, and preservative. Long term stability and stain removal performance of the composition are also disclosed.

2. Description of the Related Art

Conventional laundering processes using automatic washing machines are well known in the art. Those processes, when using commercial detergents, are generally effective in removing everyday stains from laundry items but are sometimes insufficient to remove tough stains such as those of used motor oil, blood, coffee, ink, dirt, grass and wine, etc. In order to effectively remove such tough stains, it is desirable to pretreat (or prespot) the stains before the laundry items are washed. In an exemplary pretreatment, a pretreatment composition is delivered to the stains and the formulation-treated stains are rubbed or scrubbed so that the stains are loosened, dislodged, or dissolved. Thereafter, the treated stains are effectively removed by one of the conventional laundering processes.

Ordinary laundry pretreatment compositions for loosening tough stains on fabrics generally contain considerable amounts of oxidant and/or bleach components. The bleach components may be ozone, hypochlorides, halogen oxides, peroxides or other conventional bleaching agents. The bleaching components may also be bleach catalysts that facilitate oxidation reactions by oxygen in the air. One problem associated with the bleaching components is that they may not be compatible with other essential ingredients of the composition, including enzymes. Moreover, the bleach components may also cause discoloration of delicate fabrics if not timely rinsed with water. Therefore, bleach components may need to be excluded in some pretreatment compositions.

Use of enzymes in cleaning compositions for stain removal is also known in the art. For example, when used in laundry detergent compositions enzymes may degrade a wide variety of soils or stains that are deposited on or embedded within fabrics or otherwise change the properties of the same. In the case of dish washing detergents, enzymes have been found to degrade various fats and oils, proteins, starches and the like which are adhered to the surfaces of dishes. In general, enzymes in cleaning compositions function to loosen soils and stains on a surface and render them more readily removed during a washing process.

Moreover, as recognized in U.S. Pat. No. 4,111,855, "the formulation of enzyme-containing liquid detergent compositions is a very delicate task due to the rapid decrease of the enzymatic activity in aqueous medium during storage" (col. 1, lines 39-42). Although enzymes may be stabilized in aqueous cleaning compositions by a variety of methods, the formation of an enzyme-containing emulsion has been found to substantially prevent enzyme degradation in pretreatment compositions. The emulsion may include one or more nonionic surfactants, detersive enzymes, borax, fragrances, pH adjusting agents, thickeners, preservative, and water.

Nevertheless, in order to preserve the detergent activity of the enzymes, such emulsions must be themselves stable during storage. In some countries, including U.S., product stability is evaluated at 10° C. (low temperature storage), 20-25° C. (ambient temperature storage), and 38° C. (elevated temperature storage). In other countries, however, stability is evaluated under ambient and elevated temperatures. In any event, some enzyme-containing emulsions fail to provide sufficient stability at one or all of those temperatures, resulting in decreased soil and/or stain removal performance of same. For example, an aqueous emulsion containing 0.2% enzyme, a nonionic surfactant blend of 2% isotrideceth-8, 2% ethoxylated undecyl alcohol, and 2% ethoxylated (3 Moles) isotridecanol, 89.25% water, and other ingredients including borax, pH adjusting agents, thickeners, preservatives, and fragrance, is found to exhibit phase separation within two days at both low and ambient storage temperatures.

Hence, there is a need for an enzyme-containing liquid laundry pretreatment composition with improved long term stability under low, ambient, and/or elevated storage temperatures. Moreover, there is a need for a stable enzyme-containing pretreatment composition that that performs comparably to existing pretreatment compositions.

SUMMARY OF THE DISCLOSURE

In satisfaction of the aforementioned needs, a liquid composition for pretreatment of stained fabric is disclosed. The composition may be an aqueous emulsion and may include at least one nonionic surfactant, at least one detersive enzyme, and a fatty alcohol as a stabilizing agent. The composition may further include optional ingredients such as a small amount of thickeners, borax, cleaning agents, pH adjusting agents, fragrances, and preservatives.

The composition may include a detersive enzyme component to improve the cleaning performance thereof by breaking down proteins, fats, or carbohydrates in tough stains. In one embodiment, the detersive enzyme may include a protease enzyme. Other detersive enzymes known in the art may be used to substitute or supplement the protease enzyme. Because the detersive activities of the enzymes used in the disclosed composition are preserved by the stable emulsion, only a low level of enzymes (e.g. 0.2 wt %) may be needed to provide good pretreatment performance.

As discussed above, the composition may also include one or more nonionic surfactants. The nonionic surfactants may have dual functions of (1) acting as cleaning agents to remove the soils and/or stains and (2) acting as emulsifiers to stabilize the enzyme. Suitable nonionic surfactants may include one or more ethoxylated alcohols. The ethoxylated alcohols may include 1, 2, 3, or more Moles of ethoxy moieties. The nonionic surfactants may be included in the disclosed composition at a concentration of from 1 wt % to 20 wt %.

Suitable fatty alcohols for used in the composition may include C12-C14 alcohols, which may be prepared from raw materials obtainable from natural sources. Fatty alcohols with shorter chains, such as a C10 alcohol, may have a less desirable toxicology profile that C12-C14 alcohols. On the other hand, fatty alcohols with longer chain, such as a C16 alcohol, may be less effective in stabilizing emulsions because of their higher melting point (and therefore "waxier" property). Surprisingly, the fatty alcohols used in the composition may be effective even at a very low concentration, such as 0.1-0.2 wt %.

To formulate a stable emulsion and/or to further improve the pretreatment performance thereof, the composition may also include one or more thickeners. In one embodiment, the thickener may be sodium polycarboxylate, acrylic copolymer, or mixtures thereof. In one embodiment, the thickener is included in the composition at a concentration of from 0.1 wt % to 1 wt %.

The composition may further include boron compound as a detergent booster to improve the cleaning performance of the composition and/or as a buffer to help maintaining a desirable pH range. The boron compound may also help stabilizing the enzyme component of the composition. In one embodiment, the composition may include from 0.1 wt % to 2 wt % borax although other suitable concentrations may also be used.

The composition may also include one or more acid and/or base components in order to maintain a desirable pH range, to further facilitate stain removal, and/or to stabilize the enzyme components. In one embodiment, the acid may be citric acid and the base may be sodium hydroxide.

The composition may optionally include a fragrance to enhance ambience when the composition is applied to the stained fabric. In particular, when the stained fabric has a malodor associated with it, the fragrance may help to mask the odor. The type, tone, and concentration of the fragrance would be obvious to one of ordinary skill in the art. In one embodiment, the composition may include up to 1.0 wt % fragrance.

Finally, the composition may include a preservative to inhibit microorganism formation. In particular, the preservative may prevent the biological degradation of the sugar-based surfactant. The type and concentration of the suitable preservative would be obvious to one of ordinary skill in the art in view of this disclosure.

To avoid discoloration and other undesirable damages to the treated fabric, the pretreatment composition may be essentially free of any bleach components, such as bleaching agents, bleach precursors and bleach catalysts. Moreover, the pretreatment composition may also be essentially free of any alcoholic solvents, propellant, and ionic surfactants.

Other advantages and features of the disclosed compositions will be described in greater detail below. It will also be noted here and elsewhere that the pretreatment composition disclosed herein may be suitably modified to be used in a wide variety of cleaning operations, such as on-the-go treatment of stained fabrics, by one of ordinary skill in the art without undue experimentation.

DETAILED DESCRIPTION OF THE PRESENTLY PREFERRED EMBODIMENTS

This disclosure is generally related to a liquid composition for pretreatment of stained fabric. In general, the composition may include at least one nonionic surfactant, at least one detersive enzyme, a fatty alcohol as a stabilizing agent, and water. The composition may further include optional ingredients such as a small amount of anionic surfactant, borax, cleaning agents, pH adjusting agent, fragrance, and preservative. The composition may be in the form of a stable emulsion even after long term storage without significant loss of its pretreatment performance. To that end, the fatty alcohols, in particular C12-C14 fatty alcohols, in the composition stabilize the emulsion to preserve, among other things, the detersive activity of the enzyme therein. Without wishing to be bound by any particular theory, it is contemplated that the interaction between the fatty alcohol and non-ionic surfactant(s) may contribute to the formation of a more stable emulsion than the non-ionic surfactant(s) alone.

Non-Ionic Surfactant

One suitable type of nonionic surfactant for the disclosed composition is ethoxylated nonionic surfactants. In particular, the ethoxylated nonionic surfactants may include ethoxylated aliphatic alcohols, ethoxylated alkyl phenols, and mixtures thereof. More specifically, the ethoxylated nonionic surfactants include primary or secondary alcohol ethoxylates having a carbon length of 8 to 22 carbon atoms and containing from 1 to about 100 moles of ethylene oxide per mole of alcohol. The primary and secondary alcohol of the ethoxylate may also include a methyl branch on the carbon chain, particularly toward the terminal end of the carbon chain. In one embodiment, the disclosed composition includes a blend of isotrideceth-8, ethoxylate (3 Moles) isotridecanol, and ethoxylated undecyl alcohol. Another type of alcohol ethoxylate is alkylphenol ethoxylates containing from 1 to about 50 moles of ethylene oxide per mole of phenol, and mixtures thereof.

The ethoxylated nonionic surfactants may be manufactured by the condensation reaction of one mole of a primary or secondary alcohol containing 8 to 22 carbon atoms with 1 to about 100 moles of ethylene oxide. Examples of commercially available ethoxylated nonionic surfactants include the Neodol series from Shell, e.g., Neodol 23-6.5, having alcohols with carbon chains of 12-13 and an average of 6.5 moles of ethylene oxide per male of alcohol; Neodol 25-7 (12-15 carbons, 7 moles ethylene oxide); Neodol 25-9 (12-15 carbons, 9 moles ethylene oxide); and Neodol 45-11 (14-15 carbons, 11 moles ethylene oxide). Other commercial examples include the linear secondary alcohols with carbon lengths from 11 to 15 with an average of 7 moles of ethylene oxide, such as Tergitol 15-S-7 and its counterpart. Tergitol 15-S-9, which has an average of 9 moles of ethylene oxide.

The alkyl phenol ethoxylates usually contain an alkyl group having between 6 and 18 carbons and an average of about 3 to 25 moles of ethylene oxide per mole of phenol. Specific examples include nonyl phenol polyglycol ethers with an average of 9.5 moles of ethylene oxide such as IGEPAL CO-630 from GAF; dodecyl phenol polyglycol ethers with an average of 12 moles of ethylene oxide; and octyl phenol polyglycol ethers with an average of 9 moles of ethylene oxide such as Triton X-100. For further examples, see U.S. Pat. No. 3,953,353, cols. 2-6.

The concentration of ethoxylated nonionic surfactant utilized in accordance with this disclosure may be from 1 wt % to 20 wt %, more preferably from 3 wt % to 10 wt %, and most preferably from 5 wt % to 8 wt %. Other concentration ranges may also be use so long as its inclusion does not significantly affect the stability of the emulsion and the detersive enzyme contained therein. Without wishing to be bound by any particular theory, these ethoxylated nonionic surfactants are used as wetting agents and emulsifiers to allow the pretreatment composition to wet and emulsify the stain to be removed.

In one embodiment, the composition may be essentially free of ionic surfactants. In another embodiment, the composition may be essentially free of cationic surfactant, such as quaternary ammonium salts, and anionic surfactant, such as sulfates or sulfonates. In another embodiment, the composition may be essentially free of any surfactants other than the ethoxylated nonionic surfactant. Without wishing to be bound by any particular theory, the exclusion of one or more surfactants may contribute to the formulation of a stable emulsion.

Detersive Enzyme

The composition may also include one or more detersive enzymes to improve the cleaning performance thereof by breaking down proteins, fats, or carbohydrates in tough stains. Suitable detersive enzymes may include proteases, amylases, lipases, cellulases, or mixtures thereof.

Detersive enzymes may be incorporated at suitable levels to provide effective stain removal. For example, the disclosed composition may include from 0.001 wt % to 2 wt % or from 0.01 wt % to 1 wt % of active protease enzyme. In one embodiment, the disclosed composition includes from 0.1-0.3 wt % of active protease enzyme. The concentrations and types of protease enzyme disclosed herein should not be considered as limiting the scope of this disclosure. It is to be understood, however, the amount and type of enzymes included in the composition should not affect the long term storage stability of the composition as disclosed herein.

Suitable protease enzymes for use in the cleaning composition of the present invention are of vegetable, animal, bacterial, mold and fungal origin. Non-limiting examples of proteases enzyme suitable for use in the disclosed composition include the subtilisins obtained from particular strains of *B. subtilis* and *B. licheniforms*. Another suitable protease is obtained from a strain of *Bacillus*, having maximum activity throughout the pH range of 8-12, developed and sold by Novo Industries A/S under the registered trade name ESPERASE®. Other suitable protease enzymes suitable for removing protein-based stains that are commercially available include those sold under the trade names ALCALASE® and SAVINASE® by Novo Industries A/S and MAXATASE® by International Bio-Synthetics, Inc.

The usable cellulase in the disclosed embodiments includes both bacterial or fungal cellulase. Preferably, they will have a pH optimum of between 5 and 9.5. Examples include cellulases produced by a strain of *Humicola insolens* (*Humicola grisea* var. *thermoidea*), particularly the *Humicola* strain DSM 1800, and cellulases produced by a fungus of *Bacillus* N or a cellulase 212-producing fungus belonging to the genus *Aeromonas*, and cellulase extracted from the hepatopancreas of a marine mollusk (*Dolabella Auricula Solander*).

Amylases suitable for use in the present cleaning composition include, for example, .alpha.-amylases obtained from a special strain of *B. licheniforms*. Amylolitic proteins include, for example, RAPIDASE®, available from International Bio-Synthetics, Inc. and TERMAMYL®, available from Novo Industries.

Examples of suitable lipases for use herein include those of animal, plant, and microbiological origin. Although only limited studies on lipase distribution in plants have been conducted, suitable lipase enzymes are present in cambium, bark, and in plant roots. In addition, lipases have been found in the seeds of fruit, oil palm, lettuce, rice, bran, barley and malt, wheat, oats and oat flour, cotton tung kernels, corn, millet, coconuts, walnuts, *fusarium, cannabis* and cucurbit. The lipase may be enzyme derived from *Humicola lanuginosa* and commercially available from Novo Enzyme under the trade name LIPOLASE®.

Stabilizer

In order to maintain the composition as a stable emulsion during long term storage, one or more stabilizer is used. One particularly suitable stabilizer is one or more fatty alcohols. For example, the fatty alcohol may include C12-C14 alkanols and mixtures thereof. In one embodiment, the one or more alkanols may be selected from the group consisting of lauryl alcohol, cetyl alcohol, and mixtures thereof. Alkanols with less than 10 carbon atom is generally less preferably due to their less desirable toxicologically profiles. Longer chain alkanols, on the other hand, have a higher boiling point and may be too "waxy" for formulating a stable emulsion as disclosed herein.

In addition to contributing to the stability of the disclosed composition as an emulsion, the stabilizer may also improve the performance, such as soil removal, of the composition. Moreover, only a low level of the stabilizer is necessary to provide the stabilization benefit. For example, the disclosed composition may include from 0.07 to no more than 2 wt % stabilizer. In another embodiment, the stabilizer may be included at a level of from 0.07 to 1 wt %, 0.07 to 0.5 wt % or 0.1 to 0.2 wt %. Higher levels of stabilizer may also be used to stabilize the disclosed composition, but it generally does not provide significantly improved stability of the composition.

Without wishing to be bound by any particular theory, the stabilizer may enhance the interaction between the nonionic surfactants and water phases, where the stabilizer behaves as a self-assembled surfactant at the oil/water interface to facilitate the formation of a stable emulsion or even a stable microemulsion. Further, the efficiency of the self-assembly may be dependent on the ratio of the nonionic surfactants and the stabilizer, the total concentration of the surfactants and/or stabilizer, or both. In some embodiments, the self-assembly between surfactant(s) and stabilizer to facilitate the formation of stable emulsions may require the presence of only a small amount of linkers, such as no more than 0.5 wt %, 0.2 wt %, or even 0.1 wt %.

Thickener

The disclosed composition may also include one or more optional thickeners. A non-limiting example of suitable thickeners may be acrylic polymers or salts thereof. In one embodiment, the thickener may be an alkali salt of acrylic polymer, such as the acrylic polymer sold under the trade name ACUSOL™ 820 (Rohm and Haas Company, 100 Independence Mall West, Philadelphia, Pa. 19106-2399), which is a Hydrophobically modified Alkali Soluble acrylic polymer Emulsion (HASE) with high aqueous thickening and stabilizing efficiency, especially when neutralized to a pH above 7 by adding alkalis.

The concentration of the thickener included in the composition may depend on the rheological properties desirable for the specific application. For example, if the composition is formulated as a spray-on pretreatment composition, less thickeners may be requires than when the composition is formulated as a paste or gel. In any event, the rheological properties of the composition should not interfere with the stability of the emulsion or the activity of the enzyme. In one embodiment, the composition includes from 0.5 wt % to 5 wt %, more preferably from 0.5 wt % to 3 wt %, and most preferably from 0.5 wt % to 1.5 wt % thickeners. Moreover, without wishing to be bound by any particular theory, the fatty alcohol used as a stabilizer in the composition may also contribute to the final rheological property of the composition even though it is not generally referred to as thickeners in this disclosure.

Boron Compound

The composition may further optionally include one or more boron compound as a detergent booster to improve the cleaning performance of the composition and/or as a buffer to help maintaining a desirable pH range. The boron compound may also help stabilizing the enzyme component of the composition. In one embodiment, the composition may include from 0.1 wt % to 2 wt % of the boron compound although other suitable concentrations may also be used.

The boron compound used in the disclosed composition may include alkali metal borates (e.g., sodium ortho-, meta- and pyroborate and sodium pentaborate), boric acid, boric oxide, and other suitable boron-containing chemicals used in detergent composition. Substituted boric acids (e.g., phenylboronic acid, butane boronic acid and a p-bromo phenylboronic acid) can also be used in place of boric acid. In one embodiment, the boron compound is borax and is included in the disclosed composition at a concentration of from 0.1 wt % to 2 wt %.

Additional Cleaning Agents

The composition may include one or more additional cleaning agents to improve the stain removal performance thereof. In one embodiment, the cleaning agents may be a polymer blend sold under the trade name ACUSOL™ 935N (Rohm and Haas Company, 100 Independence Mall West, Philadelphia, Pa. 19106-2399), which is used in this formulation to boost cleaning performance of the composition, especially on dirt. Moreover, ACUSOL™ 935N may also function as a water softener and lime build up preventer. In one embodiment, the additional cleaning agent is included in the composition at a concentration of from 0.1 wt % to 2 wt %, more preferably from 0.2 wt % to 1 wt %, and most preferably from 0.3 wt % to 0.7 wt %.

pH Adjusting Agents

The composition may also optionally include one or more pH adjusting agents, such as acid and/or base components in order to maintain a desirable pH range, to further facilitate stain removal, and/or to stabilize the enzyme components. The acid or base component may be either organic or inorganic. In one embodiment, the acid may be citric acid included in the composition at a concentration of from about 0.1 wt % to about 2 wt %. In another embodiment, the base may be sodium hydroxide included in the composition at a concentration of from about 0.1 wt % to about 1 wt %.

The pH of the composition may be maintained relatively neutral or slightly basic in order to preserve the activity of the enzyme included therein. For example, the pH of the composition may be maintained at 6.5-9.5. In one embodiment, the pH of the composition is maintained at 8.0-8.8.

Preservatives

In order to prevent degradation cause by microorganism, the composition may optionally include one or more preservatives. In particular, the preservative may prevent the biological degradation of the sugar-based surfactant. Suitable preservatives for use in the disclosed composition include, but are not limited to, Bioban™ CS-1135 marketed by Dow, Neolone™ M-10 and Kathon™ CG-ICP marketed by Rohm & Haas, and Proxel® GXL marketed by Arch Chemicals. The preservative may be included in the disclosed composition at a concentration of from about 0.1 wt % to about 1 wt %. It is to be understood that the type and concentration of the preservative disclosed above should not be considered as limiting the scope of this disclosure. Other suitable preservative may be used in the disclosed composition without undue experimentation in view of this disclosure.

Fragrances

The composition may optionally include a fragrance to enhance ambience when the composition is applied to the stained fabric. In particular, when the stained fabric has a malodor associated with it, the fragrance may help to mask the odor. The type, tone, and concentration of the fragrance would be obvious to one of ordinary skill in the art. In one embodiment, the composition may include up to 1.0 wt % fragrance.

In one embodiment, the fragrances used in the composition may be obtained from International Flavors and Fragrances, a U.S. corporation having an office at 521 West 57$^{th}$ Street, New York, N.Y. 10019 (http://www.iff.com). Of course, one skilled in the art will know that other suppliers of fragrances exist and this disclosure is not limited to the particular fragrances utilized herein. In one embodiment, the fragrance may be included in the composition at a concentration of from 0.01 wt % to 1 wt %, more preferably from 0.05 wt % to 0.5 wt %, and most preferably about 0.1 wt %, although other fragrance concentrations may also be used without undue experimentation.

Water

The disclosed liquid composition may include water as a primary solvent. In one embodiment, the composition includes at least 80 wt %, more preferably at least 85 wt %, and most preferably at least 87 wt % water. To avoid discoloration and other undesirable damages to the treated fabric, the pretreatment composition may be essentially free of any bleach components, such as bleaching agents, bleach precursors and bleach catalysts. Moreover, the pretreatment composition may also be essentially free of any alcoholic solvents, propellant, and ionic surfactants.

Five exemplary compositions are disclosed below. It should be noted that this disclosure is not limited to the particular compositions and acceptable ranges of the various ingredients are also set forth below.

FORMULATION I

| Function/Description | Chemical Name/Trade Name | wt % |
|---|---|---|
| Solvent | Tap water | 89.25 |
| Nonionic surfactant | Isotrideceth-8 | 2 |
| Nonionic surfactant | Ethoxylated undecyl alcohol | 2 |
| Nonionic surfactant | Isotridecanol, ethoxylated (3 Mole) | 2 |
| Cleaning agent | Blend of Acrylic acid detergent homopolymer and partially neutralized detergent polymer/ ACUSOL ® 935N | 0.5 |
| Enzyme | Protease Enzyme | 0.20 |
| Stabilizer | Dodecanol | 0.1 |
| Thickener | Acrylic copolymer (bulk)/ Acusol ® 820 | 0.5 |
| pH adjusting agent/ cleaning agent/enzyme stabilizer | Citric acid 50% (aqueous) | 1.7 |
| pH adjusting agent/ cleaning agent/enzyme stabilizer | Sodium hydroxide 50% (aqueous) | 0.9 |
| Buffer/cleaning agent | Borax, 5 Mols | 0.5 |
| Fragrance | Fragrance | 0.1 |
| Preservative | Proxel ® GXL | 0.25 |
| | | 100.00 |

FORMULATION II

| Function/Description | Chemical Name/Trade Name | wt % |
|---|---|---|
| Solvent | Tap water | 89.15 |
| Nonionic surfactant | Isotrideceth-8 | 2 |
| Nonionic surfactant | Ethoxylated undecyl alcohol | 2 |
| Nonionic surfactant | Isotridecanol, ethoxylated (3 Mole) | 2 |
| Cleaning agent | Blend of Acrylic acid detergent homopolymer and partially neutralized detergent polymer/ ACUSOL ® 935N | 0.5 |
| Enzyme | Protease Enzyme | 0.20 |
| Stabilizer | Dodecanol | 0.2 |
| Thickener | Acrylic copolymer (bulk)/ Acusol ® 820 | 0.5 |
| pH adjusting agent/ cleaning agent/enzyme stabilizer | Citric acid 50% (aqueous) | 1.7 |
| pH adjusting agent/ cleaning agent/enzyme stabilizer | Sodium hydroxide 50% (aqueous) | 0.9 |

-continued

FORMULATION II

| Function/Description | Chemical Name/Trade Name | wt % |
|---|---|---|
| Buffer/cleaning agent | Borax, 5 Mols | 0.5 |
| Fragrance | Fragrance | 0.1 |
| Preservative | Proxel ® GXL | 0.25 |
| | | 100.00 |

FORMULATION III

| Function/Description | Chemical Name/Trade Name | wt % |
|---|---|---|
| Solvent | Tap water | 89.25 |
| Nonionic surfactant | Isotrideceth-8 | 2 |
| Nonionic surfactant | Ethoxylated undecyl alcohol | 2 |
| Nonionic surfactant | Isotridecanol, ethoxylated (3 Mole) | 2 |
| Cleaning agent | Blend of Acrylic acid detergent homopolymer and partially neutralized detergent polymer/ ACUSOL ® 935N | 0.5 |
| Enzyme | Protease Enzyme | 0.20 |
| Stabilizer | Tetradecanol | 0.1 |
| Thickener | Acrylic copolymer (bulk)/ Acusol ® 820 | 0.5 |
| pH adjusting agent/ cleaning agent/enzyme stabilizer | Citric acid 50% (aqueous) | 1.7 |
| pH adjusting agent/ cleaning agent/enzyme stabilizer | Sodium hydroxide 50% (aqueous) | 0.9 |
| Buffer/cleaning agent | Borax, 5 Mols | 0.5 |
| Fragrance | Fragrance | 0.1 |
| Preservative | Proxel ® GXL | 0.25 |
| | | 100.00 |

FORMULATION IV

| Function/Description | Chemical Name/Trade Name | wt % |
|---|---|---|
| Solvent | Tap water | 89.15 |
| Nonionic surfactant | Isotrideceth-8 | 2 |
| Nonionic surfactant | Ethoxylated undecyl alcohol | 2 |
| Nonionic surfactant | Isotridecanol, ethoxylated (3 Mole) | 2 |
| Cleaning agent | Blend of Acrylic acid detergent homopolymer and partially neutralized detergent polymer/ ACUSOL ® 935N | 0.5 |
| Enzyme | Protease Enzyme | 0.20 |
| Stabilizer | Tetradecanol | 0.2 |
| Thickener | Acrylic copolymer (bulk)/ Acusol ® 820 | 0.5 |
| pH adjusting agent/ cleaning agent/enzyme stabilizer | Citric acid 50% (aqueous) | 1.7 |
| pH adjusting agent/ cleaning agent/enzyme stabilizer | Sodium hydroxide 50% (aqueous) | 0.9 |
| Buffer/cleaning agent | Borax, 5 Mols | 0.5 |
| Fragrance | Fragrance | 0.1 |
| Preservative | Proxel ® GXL | 0.25 |
| | | 100.00 |

FORMULATION V

| Function/Description | Chemical Name/Trade Name | Wt % |
|---|---|---|
| Solvent | Tap water | 89.3 |
| Nonionic surfactant | Isotrideceth-8 | 2 |
| Nonionic surfactant | Ethoxylated undecyl alcohol | 2 |
| Nonionic surfactant | Isotridecanol, ethoxylated (3 Mole) | 2 |
| Cleaning agent | Blend of Acrylic acid detergent homopolymer and partially neutralized detergent polymer/ ACUSOL ® 935N | 0.5 |
| Enzyme | Protease Enzyme | 0.20 |
| Stabilizer | Dodecanol | 0.05 |
| Thickener | Acrylic copolymer (bulk)/ Acusol ® 820 | 0.5 |
| pH adjusting agent/ cleaning agent/enzyme stabilizer | Citric acid 50% (aqueous) | 1.7 |
| pH adjusting agent/ cleaning agent/enzyme stabilizer | Sodium hydroxide 50% (aqueous) | 0.9 |
| Buffer/cleaning agent | Borax, 5 Mols | 0.5 |
| Fragrance | Fragrance | 0.1 |
| Preservative | Proxel ® GXL | 0.25 |
| | | 100.00 |

FORMULATION VI

| Function/Description | Chemical Name/Trade Name | Wt % |
|---|---|---|
| Solvent | Tap water | 89.35 |
| Nonionic surfactant | Isotrideceth-8 | 2 |
| Nonionic surfactant | Ethoxylated undecyl alcohol | 2 |
| Nonionic surfactant | Isotridecanol, ethoxylated (3 Mole) | 2 |
| Cleaning agent | Blend of Acrylic acid detergent homopolymer and partially neutralized detergent polymer/ ACUSOL ® 935N | 0.5 |
| Enzyme | Protease Enzyme | 0.20 |
| Thickener | Acrylic copolymer (bulk)/ Acusol ® 820 | 0.5 |
| pH adjusting agent/ cleaning agent/enzyme stabilizer | Citric acid 50% (aqueous) | 1.7 |
| pH adjusting agent/ cleaning agent/enzyme stabilizer | Sodium hydroxide 50% (aqueous) | 0.9 |
| Buffer/cleaning agent | Borax, 5 Mols | 0.5 |
| Fragrance | Fragrance | 0.1 |
| Preservative | Proxel ® GXL | 0.25 |
| | | 100.00 |

Stability Evaluation

Stability evaluation under various temperatures indicates that the disclosed compositions with effective amounts of stabilizers exhibit significantly improved long term storage stability than compositions without any stabilizer or with in effective amounts of stabilizers.

For example, both Formulations I and II are stable (with no phase-separation) for at least 90 days at 10° C. (low temperature storage), 20-25° C. (ambient temperature storage), and 38° C. (elevated temperature storage). Formulation V, on the other hand, becomes unstable, i.e. exhibiting phase-separation, under low and ambient temperature storage conditions within 90 days, probably due to its low (ineffective) level of stabilizer. Furthermore, Formulation VI (no stabilizer) becomes unstable under low and ambient temperature storage conditions within only 7 days, sometime even within 2 days.

Performance Evaluation

The fabric pretreatment performance of the disclosed composition may be comparable to that of a commercial pretreatment product, such as Shout® Liquid currently marketed by S.C. Johnson. One important aspect of the pretreatment performance is the ability to loosen or remove various types of stains from fabric.

To evaluate the pretreatment performance of the disclosed composition, laboratory stain removal testing is conducted using slightly modified protocols and stains outlined in ASTM Method D4265 (1998). For better performance differentiation between tested pretreatment compositions, the stained fabrics are prepared so that the stains are difficult to be removed. Specifically, stains are placed on fabric that is lying flat on a table instead of applying the stain to suspending fabric, as specified in the ASTM Method D4265 (1998). This modification has been deemed satisfactory by the National Advertising Division of the Better Business Bureau.

In particular, a properly-sized swatch of 100% cotton are prepared according to the ASTM D4265 (1998) and stained using the modified staining process discussed above. The stained swatch is allowed to set overnight.

On the following day, the stained swatch is soaked with 2.0 milliliters of the tested pretreatment composition, rubbed with a brush, and allowed to set for five minutes so that the tested composition can loosen or dislodge the stain. Thereafter, the treated swatch is placed into a Whirlpool washing machine with 4 bath towels as ballast and 45 grams of Tide® Liquid detergent. The swatch is then laundered with medium water level (17-19 gallons of water) at 90° F. wash and 60° F. rinse.

After laundering, the swatch is removed from the washing machines, ironed on the reverse side of the stain, and analyzed with a Minolta Colorimeter to generate a ΔE measurement for the swatch, wherein a higher ΔE indicates more stain remaining on the swatch. For each type of stain, the testing is repeated five to ten times with each pretreatment composition so that an average ΔE value can be obtained. The results of the tests are listed in the table below.

TABLE 1

Performance Comparison between Formulation I and a Commercial Pretreatment Composition

| Stains | Shout ® Liquid (ΔE) | Formula I (ΔE) |
|---|---|---|
| Used Motor Oil | 9.60 | 9.90 |
| Ketchup | 0.85 | 0.75 |
| Wine | 2.53 | 2.65 |
| Spaghetti Sauce | 3.73 | 3.38 |
| Blood (Beef) | 3.17 | 3.12 |
| Coffee | 1.81 | 2.05 |
| Grape Juice | 1.61 | 1.80 |
| Blueberry Juice | 0.98 | 1.38 |
| Grass Slurry | 5.22 | 5.12 |
| Dirt Slurry | 4.02 | 4.39 |
| Make-up Liquid | 1.23 | 0.78 |

As clearly indicated in Table 1, both disclosed compositions outperform the commercial composition when used to treat certain type of stains (ketchup, blood, spaghetti sauce, make-up liquid, and grass slurry). For some other type of stains (used motor oils, coffee, wine, grape and blueberry juices, etc.), however, the performances of the disclosed compositions are less satisfactory than, but still comparable to, that of the commercial composition. More specifically, the disclosed compositions are comparable to the commercial composition because the ΔE difference between the disclosed composition and commercial composition is no greater than 0.5 with respect to the stains tested above.

While only certain embodiments have been set forth, alternative embodiments and various modifications will be apparent from the above descriptions to those skilled in the art. These and other alternatives are considered equivalents and within the spirit and scope of this disclosure.

What is claimed:

1. A composition for treating stained fabric, the composition forming an aqueous emulsion, comprising:
- from 1 wt % to 6 wt % nonionic surfactant;
- from 0.001 wt % to 2 wt % detersive enzyme;
- from 0.1 wt % to 0.2 wt % fatty alcohol consisting of a C12-C14 alcohol, the fatty alcohol stabilizing the aqueous emulsion; and
- water,
- wherein the composition remains a stable emulsion after 90 days of storage at 10° C., and wherein the composition is free of ionic surfactants.

2. The composition of claim 1, wherein the composition remains a stable emulsion after 90 days of storage at 38° C.

3. The composition of claim 1, wherein the detersive enzyme comprises protease enzyme.

4. The composition of claim 3, wherein the protease enzyme is included at a concentration of 0.01 wt % to 1 wt %.

5. The composition of claim 1, further comprising from about 0.1 wt % to about 2 wt % boron compound.

6. The composition of claim 5, wherein the boron compound comprises borax.

7. The composition of claim 1, wherein the nonionic surfactant comprises at least one ethoxylated alcohol.

8. A composition for treating stained fabric, the composition forming an aqueous emulsion, comprising:
- from 1 wt % to 6 wt % nonionic surfactant;
- from 0.01 wt % to 1 wt % detersive enzyme;
- from 0.1 wt % to 0.2 wt % fatty alcohol consisting of a C12-C14 alcohol, the fatty alcohol stabilizing the aqueous emulsion; and
- water,
- wherein the composition remains a stable emulsion after 90 days of storage at 10° C., and wherein the composition is free of ionic surfactants.

9. The composition of claim 8, wherein the nonionic surfactant comprises at least one ethoxylated alcohol.

10. The composition of claim 8, wherein the nonionic surfactant comprises a mixture of isotrideceth-8, ethoxylated isotridecanol, and ethoxylated undecyl alcohol.

11. The composition of claim 8, wherein the composition remains a stable emulsion after 90 days of storage at 38° C.

12. The composition of claim 8, wherein the detersive enzyme comprises protease enzyme.

13. The composition of claim 8, further comprising from about 0.1 wt % to about 2 wt % borax.

14. A composition for treating stained fabric, the composition forming an aqueous emulsion, comprising:
- from 1 wt % to 6 wt % nonionic surfactant;
- from 0.1 wt % to 0.2 wt % detersive enzyme;
- from 0.1 wt % to 0.2 wt % fatty alcohol consisting of a C12-C14 alcohol, the fatty alcohol stabilizing the aqueous emulsion; and
- water,
- wherein the composition remains a stable emulsion after 90 days of storage at 10° C., and wherein the composition is free of ionic surfactants.

15. The composition of claim 14, wherein the nonionic surfactant consists essentially of at least one ethoxylated alcohol.

16. The composition of claim 14, wherein the composition further comprises from 0.1 wt % to 1 wt % thickener selected from sodium polycarboxylate, acrylic polymer, and mixtures thereof.

17. The composition of claim 14, wherein the composition remains a stable emulsion after 90 days of storage at 38° C.

18. The composition of claim 14, wherein the detersive enzyme comprises protease enzyme.

19. The composition of claim 14, further comprising from about 0.1 wt % to about 2 wt % borax.

* * * * *